US009237615B2

(12) United States Patent
Yang et al.

(10) Patent No.: US 9,237,615 B2
(45) Date of Patent: Jan. 12, 2016

(54) HOLDING CURRENT CIRCUIT OF LED DRIVING APPARATUS AND OPERATING METHOD THEREOF

(71) Applicant: Raydium Semiconductor Corporation, Hsinchu (TW)

(72) Inventors: Yung-Hsiang Yang, Hsinchu (TW); Chung-Tai Cheng, Zhubei (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 56 days.

(21) Appl. No.: 14/170,093

(22) Filed: Jan. 31, 2014

(65) Prior Publication Data

US 2015/0223305 A1 Aug. 6, 2015

(30) Foreign Application Priority Data

Feb. 1, 2013 (TW) ..... 102103927 A

(51) Int. Cl.
*H05B 33/08* (2006.01)
*H05B 37/02* (2006.01)

(52) U.S. Cl.
CPC ..... *H05B 33/0815* (2013.01)

(58) Field of Classification Search
CPC ..... H05B 33/08
USPC ..... 315/291, 307, 308, 312, 185 R, 209 R, 315/224
See application file for complete search history.

(56) References Cited

U.S. PATENT DOCUMENTS

2011/0109245 A1* 5/2011 Lin ..... H05B 33/0824 315/294
2012/0139443 A1* 6/2012 Chu ..... H05B 33/0827 315/294

* cited by examiner

*Primary Examiner* — Minh D A

(57) ABSTRACT

An electromagnetic touch-control screen structure, comprising: a display panel; a touch-control plate over the display panel; an electromagnetic induction plate over the touch-control plate; and a cover lens attached on the electromagnetic induction plate. The electromagnetic touch-control screen of the disclosure, by deploying reasonable structure and manufacturing technique, stacks an electromagnetic induction plate with a touch-control plate, a cover lens and a display panel. Compared with existing manufacturing techniques, it can reduce one time of lamination operation, and dramatically decrease the thickness and weight of the electromagnetic structure, so that it can meet the need of lightness and thinness, for touch-control display equipments, like cellphone.

12 Claims, 8 Drawing Sheets

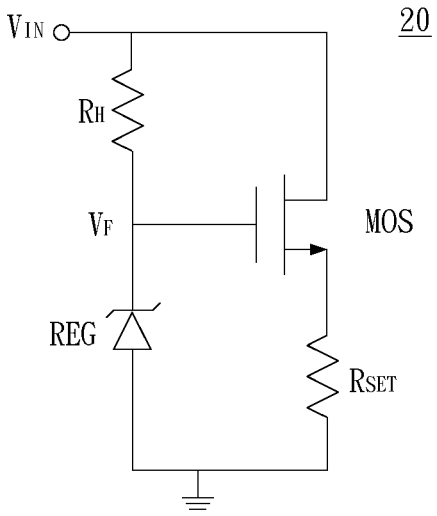
FIG. 4 (PRIOR ART)
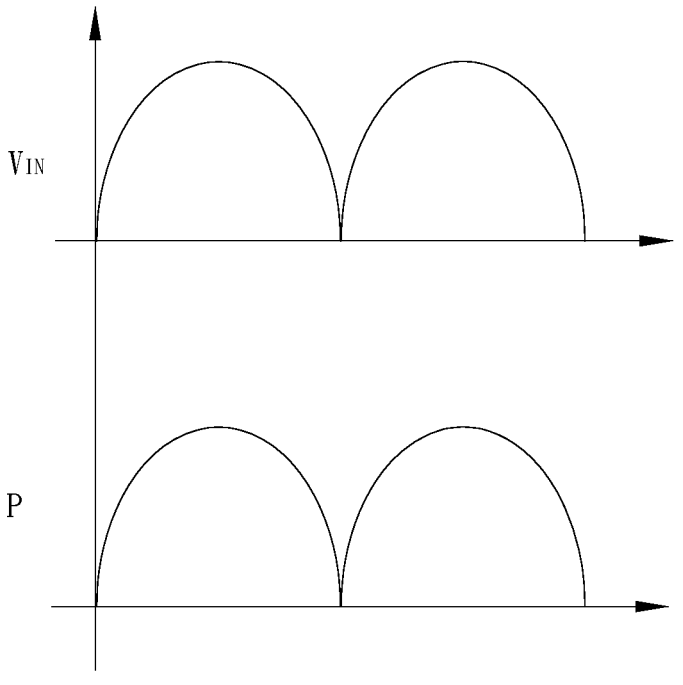
FIG. 5A (PRIOR ART)
FIG. 5B (PRIOR ART)

HOLDING CURRENT CIRCUIT OF LED DRIVING APPARATUS AND OPERATING METHOD THEREOF

CROSS-REFERENCE TO RELATED APPLICATIONS

This application claims the benefits of Taiwan Patent Application No. 102103927, filed on Feb. 1, 2013 in the Taiwan Intellectual Property Office, the disclosure of which is incorporated herein by reference in its entirety.

TECHNICAL FIELD

This invention relates to the driving of a LED, especially to a holding current circuit of a LED driving apparatus and operating method thereof.

BACKGROUND

Please refer to FIG. 1 and FIG. 2. FIG. 1 illustrates a schematic diagram of a general tri-electrode switch (TRIAC) circuit. FIG. 2 illustrates a schematic diagram of the tri-electrode switch circuit applied in a lighting circuit. As shown in FIG. 1 and FIG. 2, the tri-electrode switch TRIAC is a gate-controlled switch and it is also called "bidirectional triode thyristor" which is conductible under forward voltage or reverse voltage. When the tri-electrode switch circuit 1 is applied in a lighting product, the tri-electrode switch circuit 1 can adjust the lightness of the lighting product by changing the resistance of a variable resistor R1. When an AC voltage passes through the tri-electrode switch circuit 1, the tri-electrode switch circuit 1 changes the resistance of the variable resistor R1 to adjust a conduction angle of the AC voltage to correspondingly change the lightness of the lighting product.

However, after the tri-electrode switch circuit 1 is disposed in current LED products as shown in FIG. 2, the operation of the tri-electrode switch circuit 1 will become unstable under a condition of low voltage and current, and an input voltage $V_{IN}$ will also become unstable at low conduction angle voltage. Therefore, voltage waveforms VS1 and VS2 with different sizes will be generated as shown in FIG. 3B. If the input voltage $V_{IN}$ is zero at low conduction angle voltage, the LED apparatus 24 will even flicker.

A common solution of the above-mentioned problem is to dispose a holding current circuit 20 in the lighting circuit 2. FIG. 4 illustrates an embodiment of a conventional holding current circuit 20. As shown in FIG. 4, a resistor $R_H$ is disposed between the input voltage $V_{IN}$ and a regulator REG, and a gate of a transistor MOS is coupled between the resistor $R_H$ and the regulator REG. Because the regulator REG will generate a voltage $V_F$ and a voltage about $V_F$ will be formed at a set resistor $R_{SET}$, a current can be generated by adjusting the resistance of the set resistor $R_{SET}$. This current can be applied in the lighting circuit to be a holding current to make the input voltage $V_{IN}$ stable at low conduction angle voltage; therefore, voltage waveforms VS1' and VS2' with the same size will be generated as shown in FIG. 3C.

However, when the conventional holding current circuit 20 of FIG. 4 is applied in the lighting circuit 2 having tri-electrode switch TRIAC, if the voltage becomes higher, more power will be consumed and serious problems of high power consumption and over-heat will occur. In addition, since the voltage and the current of the current source circuit 22 disposed under the LED apparatus 24 will become larger, the power consumption of the tri-electrode switch TRIAC will also become more (as shown in FIG. 5B) to cause a over-heat problem which is needed to be overcome.

SUMMARY

Therefore, the invention provides a holding current circuit of a LED driving apparatus and operating method thereof to solve the above-mentioned problems occurred in the prior arts.

An embodiment of the invention is a holding current circuit of a LED driving apparatus. In this embodiment, the holding current circuit includes an input terminal, a holding resistor, a transistor, a comparator, a regulator, a first resistor, and a second resistor. The input terminal receives an input voltage. The holding resistor is coupled to the input terminal. A holding current flows through the holding resistor. The transistor is coupled between the holding resistor and a ground terminal. The comparator includes a first input terminal, a second input terminal, and an output terminal. The output terminal is coupled to a gate of the transistor. The regulator is coupled between the ground terminal and the first input terminal of the comparator. The first resistor is coupled to a LED string. The second resistor is coupled between the first resistor and the ground terminal. The second input terminal of the comparator is coupled between the first resistor and second resistor. The comparator receives a first voltage and a second voltage through the first input terminal and the second input terminal respectively and judges whether the second voltage is larger than the first voltage. If the judged result of the comparator is yes, the comparator outputs a control signal to turn off the transistor to prevent the holding current from passing through the transistor.

In an embodiment, the first voltage is a fixed voltage of the regulator and the second voltage is a divided voltage between the first resistor and the second resistor.

In an embodiment, the holding current circuit further includes a third resistor, another transistor, and an operational amplifier. The third resistor is coupled to the ground terminal. The another transistor is coupled between the LED string and the third resistor. Two input terminals of the operational amplifier is coupled to a reference voltage and coupled between the another transistor and the third resistor respectively. An output terminal of the operational amplifier is coupled to a gate of the another transistor.

Another embodiment of the invention is a method of operating a holding current circuit of a LED driving apparatus. In this embodiment, the holding current circuit includes an input terminal, a holding resistor, a transistor, a comparator, a regulator, a first resistor, and a second resistor. The holding resistor is coupled between the input terminal and the transistor. The transistor is coupled between the holding resistor and a ground terminal. The first resistor and the second resistor are coupled between a LED string and the ground terminal. The comparator is coupled to a gate of the transistor, the regulator, and coupled between the first resistor and the second resistor. The method includes steps of: (a) the comparator receiving a first voltage and a second voltage through the first input terminal and the second input terminal respectively and judging whether the second voltage is larger than the first voltage; and (b) if the judged result of the comparator is yes, the comparator outputting a control signal to turn off the transistor to prevent a holding current from passing through the transistor.

Another embodiment of the invention is a method of operating a holding current circuit of a LED driving apparatus. In this embodiment, the holding current circuit includes an input terminal, a holding resistor, a transistor, a comparator, and a regulator. The holding resistor is coupled between the input terminal and the transistor. The transistor is coupled between the holding resistor and a ground terminal. The regulator is coupled between the ground terminal and the comparator. The comparator is coupled to a gate of the transistor and the regulator, the method includes steps of: (a) the comparator receiving a first voltage and a second voltage through the first input terminal and the second input terminal respectively and judging whether the second voltage is larger than the first voltage; and (b) if the judged result of the comparator is yes, the comparator outputting a control signal to turn off the transistor to prevent a holding current from passing through the transistor.

Compared to the prior art, the holding current circuit of the LED driving apparatus and operating method thereof disclosed by the invention turn off the holding current circuit at high conduction angle voltage to achieve following effects of: (1) making the input voltage $V_{IN}$ stable at low conduction angle voltage to prevent the flicker of the LED apparatus; (2) effectively overcoming serious problems of high power consumption and over-heat occurred in the prior arts.

The advantage and spirit of the invention may be understood by the following detailed descriptions together with the appended drawings.

BRIEF DESCRIPTION OF THE DRAWINGS

FIG. 4 illustrates an embodiment of the conventional holding current circuit.

FIG. 5A illustrates a waveform diagram of the input voltage; FIG. 5B illustrates a schematic diagram of high power consumption caused by the conventional holding current circuit.

DETAILED DESCRIPTION

A preferred embodiment of the invention is a holding current circuit of a LED driving apparatus. In this embodiment, the LED driving apparatus having the holding current circuit is used to drive a LED to emit lights, but not limited to this. The LED driving apparatus having the holding current circuit includes a tri-electrode switch circuit. When an AC voltage passes through the tri-electrode switch circuit, the tri-electrode switch circuit changes the resistance of the variable resistor to adjust a conduction angle of the AC voltage to correspondingly change the lightness of the LED.

Figure 1:
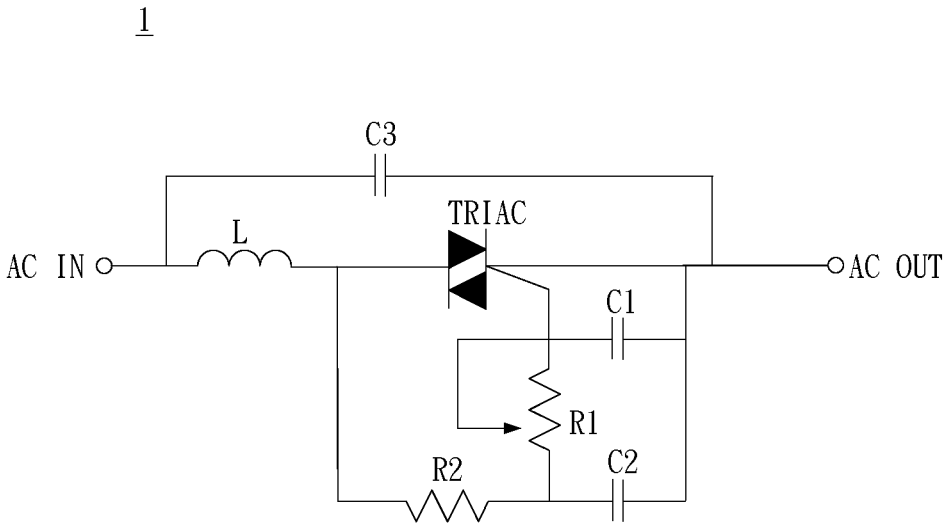
FIG. 1 (PRIOR ART)
FIG. 1 illustrates a schematic diagram of a general tri-electrode switch (TRIAC) circuit.
Figure 2:
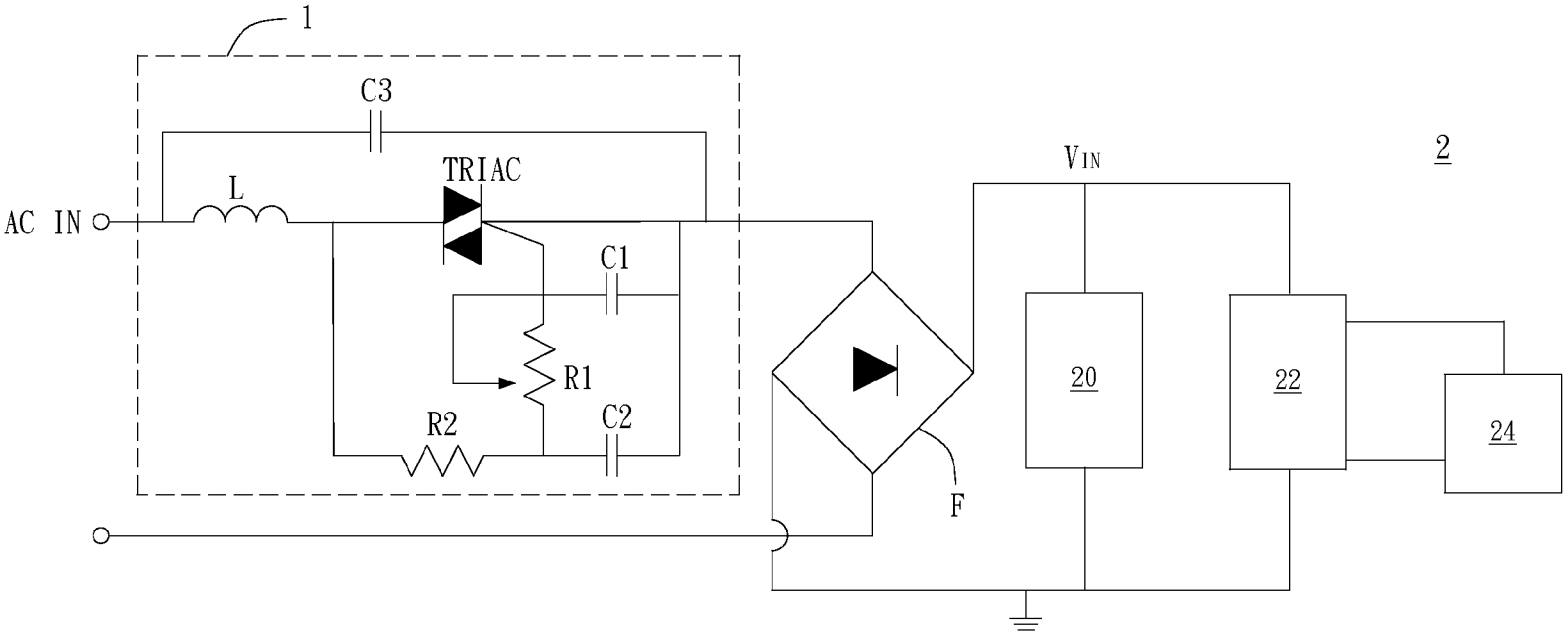
FIG. 2 (PRIOR ART)
FIG. 2 illustrates a schematic diagram of the tri-electrode switch circuit applied in a lighting circuit.
Figure 3A:
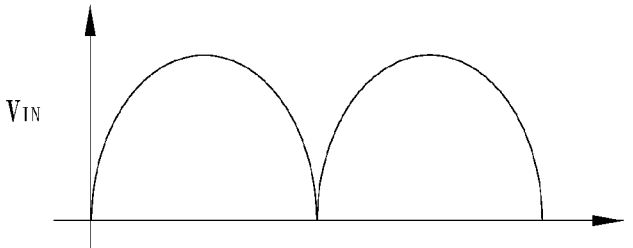
FIG. 3A (PRIOR ART)
FIG. 3A illustrates a waveform diagram of the input voltage.
Figure 3B:
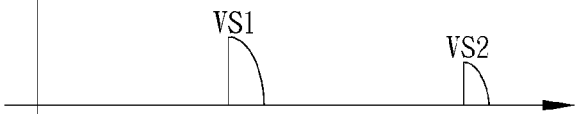
FIG. 3B (PRIOR ART)
FIG. 3B illustrates an unstable voltage waveform diagram caused by the tri-electrode switch circuit.
Figure 3C:
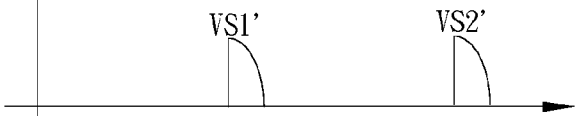
FIG. 3C (PRIOR ART)
FIG. 3C illustrates a stable voltage waveform diagram formed through a holding current circuit.
Figure 6:
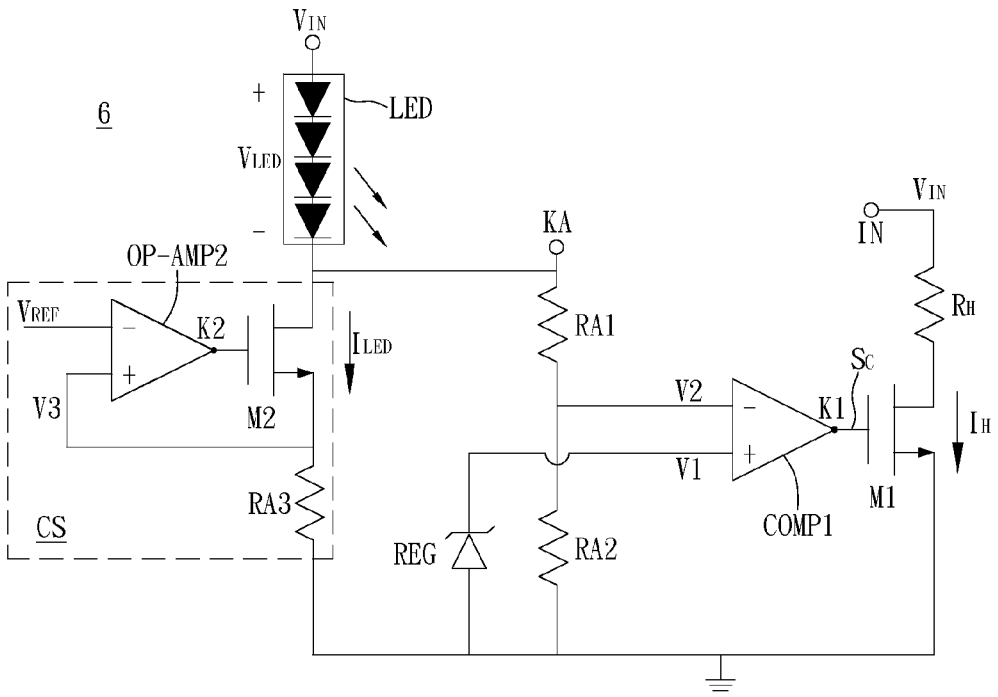
FIG. 6 illustrates a schematic diagram of the holding current circuit of the LED driving apparatus in an embodiment of the invention.

Please refer to FIG. 6. FIG. 6 illustrates a schematic diagram of the holding current circuit of the LED driving apparatus in this embodiment. As shown in FIG. 6, the holding current circuit 6 of the LED driving apparatus includes an input terminal IN, a holding resistor $R_H$, a first transistor M1, a comparator COMP1, a regulator REG, a first resistor RA1, a second resistor RA2, a third resistor RA3, a second transistor M2, and an operational amplifier OP-AMP2. Wherein, a drain of the second transistor M2 can be formed by a high-voltage MOS device and the regulator REG can be a fixed-voltage generator, but not limited to this.

The input terminal IN receives an input voltage $V_{IN}$. The holding resistor $R_H$ is coupled to the input terminal IN. The holding current $I_H$ flows through the holding resistor $R_H$. The first transistor M1 is coupled between the holding resistor $R_H$ and a ground terminal. The comparator COMP1 has a first input terminal +, a second input terminal −, and an output terminal K1. The output terminal K1 of the comparator COMP1 is coupled to a gate of the first transistor M1. The regulator REG is coupled between the ground terminal and the first input terminal + of the comparator COMP1. The first resistor RA1 is coupled to the light-emitting diode string LED. The second resistor RA2 is coupled between the first resistor RA1 and the ground terminal. The second input terminal − of the comparator COMP1 is coupled between the first resistor RA1 and the second resistor RA2.

The comparator COMP1 receives a first voltage V1 and a second voltage V2 through the first input terminal + and the second input terminal − respectively, and judges whether the second voltage V2 is larger than the first voltage V1. Wherein, the first voltage V1 is a fixed voltage of the regulator REG; the second voltage V2 is a divided voltage between the first resistor RA1 and the second resistor RA2. If the judged result of the comparator COMP1 is yes, namely the second voltage V2 is larger than the first voltage V1, the output terminal K1 of the comparator COMP1 outputs a control signal Sc to the first transistor M1 to turn off the first transistor M1, so that the holding current $I_H$ fails to pass through the first transistor M1.

The third resistor RA3 is coupled to the ground terminal. The second transistor M2 is coupled between the light-emitting diode string LED and the third resistor RA3. The first input terminal + of the operational amplifier OP-AMP2 is coupled between the second transistor M2 and the third resistor RA3. The second input terminal − of the operational amplifier OP-AMP2 is coupled to a reference voltage $V_{REF}$. The output terminal K of the operational amplifier OP-AMP2 is coupled to the gate of the second transistor M2. The operational amplifier OP-AMP2 receives a third voltage V3 and the reference voltage $V_{REF}$ through the first input terminal + and the second input terminal − respectively, and selectively turns off the second transistor M2 according to a compared result of the third voltage V3 and the reference voltage $V_{REF}$ to control whether the LED current $V_{REF}$ passing through the light-emitting diode string LED can pass through the second transistor M2 or not.

As shown in FIG. 6, the current source circuit CS includes the operational amplifier OP-AMP2, the second transistor M2, the third resistor RA3, and the reference voltage $V_{REF}$. The main function of the current source circuit CS is to provide the stable LED current $I_{LED}$ passing through the light-emitting diode string LED to the ground terminal, and use the stable LED current $I_{LED}$ to control the lightness of the light-emitting diode string LED. In the current source circuit CS, a negative feedback circuit includes the operational amplifier OP-AMP2, the second transistor M2, and the third resistor RA3 and it uses the virtual short characteristic of the operational amplifier OP-AMP2 to lock the third voltage V3 (the voltage across the third resistor RA3) at the reference voltage $V_{REF}$. If the second transistor M2 is operated at a saturation region, the LED current $I_{LED}$ passing through the second transistor M2 and the third resistor RA3 is equal to the reference voltage $V_{REF}$/the third resistor RA3; therefore, the LED current $I_{REF}$ can be adjusted by adjusting the reference voltage $V_{REF}$ or the third resistor RA3.

If the input voltage $V_{IN}$ is not large enough to drive the $V_{LED}$ across the light-emitting diode string LED, the light-emitting diode string LED will be not conducted; the voltage at the node KA will be pulled low to the ground voltage or reference voltage $V_{REF}$ due to the sink capability of the current source circuit CS, and the divided voltage (the second voltage) V2 at the node KA will be smaller than the reference fixed voltage (the first voltage V1). Therefore, the first transistor M1 will be continuously conducted and the holding current $I_H$ can continuously flow through the holding resistor $R_H$ and the first transistor M1. The physical meaning of this mechanism is that when the input voltage $V_{IN}$ is too low and the light-emitting diode string current $I_{LED}$ is too low or even zero, this mechanism will automatically supply the holding current $I_H$ to support the normal operation of the TRIAC circuit.

Figure 7:
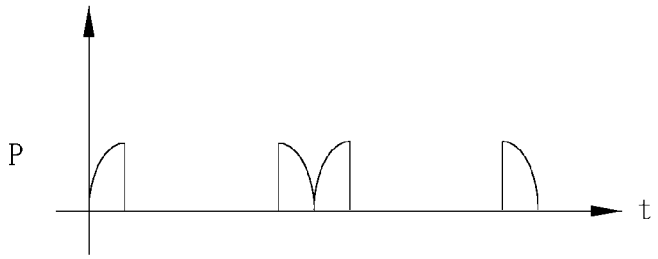
FIG. 7 illustrates a schematic diagram of reduced power consumption when the holding current circuit of the invention is applied.

Above all, if the judged result of the comparator COMP1 is that the divided voltage (the second voltage V2) between the first resistor RA1 and the second resistor RA2 is larger than the fixed voltage (the first voltage V1) of the regulator REG, the first transistor M1 will be turned off and the holding current $I_H$ will fail to pass through the first transistor M1. That is to say, if the conduction angle of the input voltage $V_{IN}$ becomes larger, the LED driving apparatus will turn off the holding current circuit 6 to reduce unnecessary power consumption as shown in FIG. 7. After comparing FIG. 7 with FIG. 5B of prior art, it can be found that the LED driving apparatus having the holding current circuit 6 can largely reduce unnecessary power consumption to save power and prevent over-heat.

Figure 8:
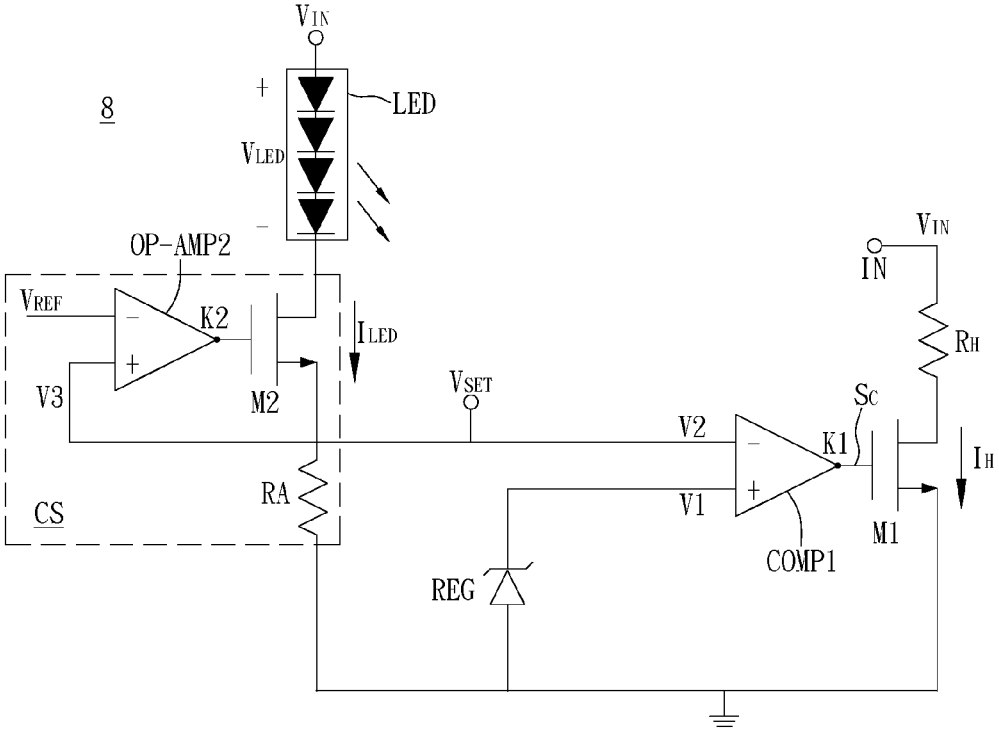
FIG. 8 illustrates a schematic diagram of the holding current circuit of the LED driving apparatus in another embodiment of the invention.

Another embodiment of the invention is also a holding current circuit of a LED driving apparatus. Please refer to FIG. 8. FIG. 8 illustrates a schematic diagram of the holding current circuit of the LED driving apparatus in this embodiment. As shown in FIG. 8, the holding current circuit 8 of the LED driving apparatus includes an input terminal IN, a holding resistor $R_H$, a first transistor M1, a comparator COMP1, a regulator REG, a resistor RA, a second transistor M2, and an operational amplifier OP-AMP2.

The input terminal IN receives an input voltage $V_{IN}$. The holding resistor $R_H$ is coupled to the input terminal IN. The holding current $I_H$ flows through the holding resistor $R_H$. The first transistor M1 is coupled between the holding resistor $R_H$ and a ground terminal. The comparator COMP1 has a first input terminal +, a second input terminal −, and an output terminal K1. The output terminal K1 of the comparator COMP1 is coupled to a gate of the first transistor M1. The regulator REG is coupled between the ground terminal and the first input terminal + of the comparator COMP1.

The comparator COMP1 receives a first voltage V1 and a second voltage V2 through the first input terminal + and the second input terminal − respectively, and judges whether the second voltage V2 is larger than the first voltage V1. Wherein, the first voltage V1 is a fixed voltage of the regulator REG; the second voltage V2 is a set voltage $V_{SET}$. If the judged result of the comparator COMP1 is yes, namely the second voltage V2 is larger than the first voltage V1, the output terminal K1 of the comparator COMP1 outputs a control signal Sc to the first transistor M1 to turn off the first transistor M1, so that the holding current $I_H$ fails to pass through the first transistor M1.

The resistor RA is coupled to the ground terminal. The second transistor M2 is coupled between the light-emitting diode string LED and the resistor RA. The first input terminal + of the operational amplifier OP-AMP2 is coupled to the set voltage $V_{SET}$. The second input terminal − of the operational amplifier OP-AMP2 is coupled to a reference voltage $V_{REF}$. The output terminal K2 of the operational amplifier OP-AMP2 is coupled to the gate of the second transistor M2. The operational amplifier OP-AMP2 receives the set voltage $V_{SET}$ and the reference voltage $V_{REF}$ through the first input terminal + and the second input terminal − respectively, and selectively turns off the second transistor M2 according to a compared result of the set voltage $V_{SET}$ and the reference voltage $V_{REF}$ to control whether the LED current $I_{LED}$ passing through the light-emitting diode string LED can pass through the second transistor M2 or not.

As shown in FIG. 8, the current source circuit CS includes the operational amplifier OP-AMP2, the second transistor M2, the resistor RA, and the reference voltage $V_{REF}$. The main function of the current source circuit CS is to provide the stable LED current $I_{FED}$ passing through the light-emitting diode string LED to the ground terminal, and use the stable LED current $I_{LED}$ to control the lightness of the light-emitting diode string LED. In the current source circuit CS, a negative feedback circuit includes the operational amplifier OP-AMP2, the second transistor M2, and the resistor RA and it uses the virtual short characteristic of the operational amplifier OP-AMP2 to lock the third voltage V3 (the voltage across the third resistor RA3) at the reference voltage $V_{REF}$. If the second transistor M2 is operated at a saturation region, the LED current $I_{LED}$ passing through the second transistor M2 and the resistor RA is equal to the reference voltage $V_{REF}$/the resistor RA; therefore, the LED current $I_{LED}$ can be adjusted by adjusting the reference voltage $V_{REF}$ or the resistor RA.

If the input voltage $V_{IN}$ is not large enough to drive the $V_{LED}$ across the light-emitting diode string LED, the light-emitting diode string LED will be not conducted; the voltage at the node KA will be pulled low to the ground voltage or reference voltage $V_{REF}$ due to the sink capability of the current source circuit CS, and the set voltage $V_{SET}$ (the second voltage) V2 will be smaller than the reference fixed voltage (the first voltage V1). Therefore, the first transistor M1 will be continuously conducted and the holding current $I_H$ can continuously flow through the holding resistor $R_H$ and the first transistor M1. The physical meaning of this mechanism is that when the input voltage $V_{IN}$ is too low and the light-emitting diode string current $I_{LED}$ is too low or even zero, this mechanism will automatically supply the holding current $I_H$ to support the normal operation of the TRIAC circuit.

Above all, if the judged result of the comparator COMP1 is that the set voltage $V_{SET}$ (the second voltage V2) is larger than the fixed voltage (the first voltage V1) of the regulator REG, the first transistor M1 will be turned off and the holding current $I_H$ will fail to pass through the first transistor M1. That is to say, if the conduction angle of the input voltage $V_{IN}$ becomes larger, the LED driving apparatus will turn off the holding current circuit 8 to reduce unnecessary power consumption as shown in FIG. 7. After comparing FIG. 7 with FIG. 5B of prior art, it can be found that the LED driving apparatus having the holding current circuit 8 can largely reduce unnecessary power consumption to save power and prevent over-heat.

Another embodiment of the invention is a method of operating a holding current circuit of a LED driving apparatus. In this embodiment, the holding current circuit includes an input terminal, a holding resistor, a transistor, a comparator, a regulator, a first resistor, and a second resistor. The holding resistor is coupled between the input terminal and the transistor. The transistor is coupled between the holding resistor and a ground terminal. The first resistor and the second resistor are coupled between a LED string and the ground terminal. The comparator is coupled to a gate of the transistor, the regulator, and coupled between the first resistor and the second resistor.

Figure 9:
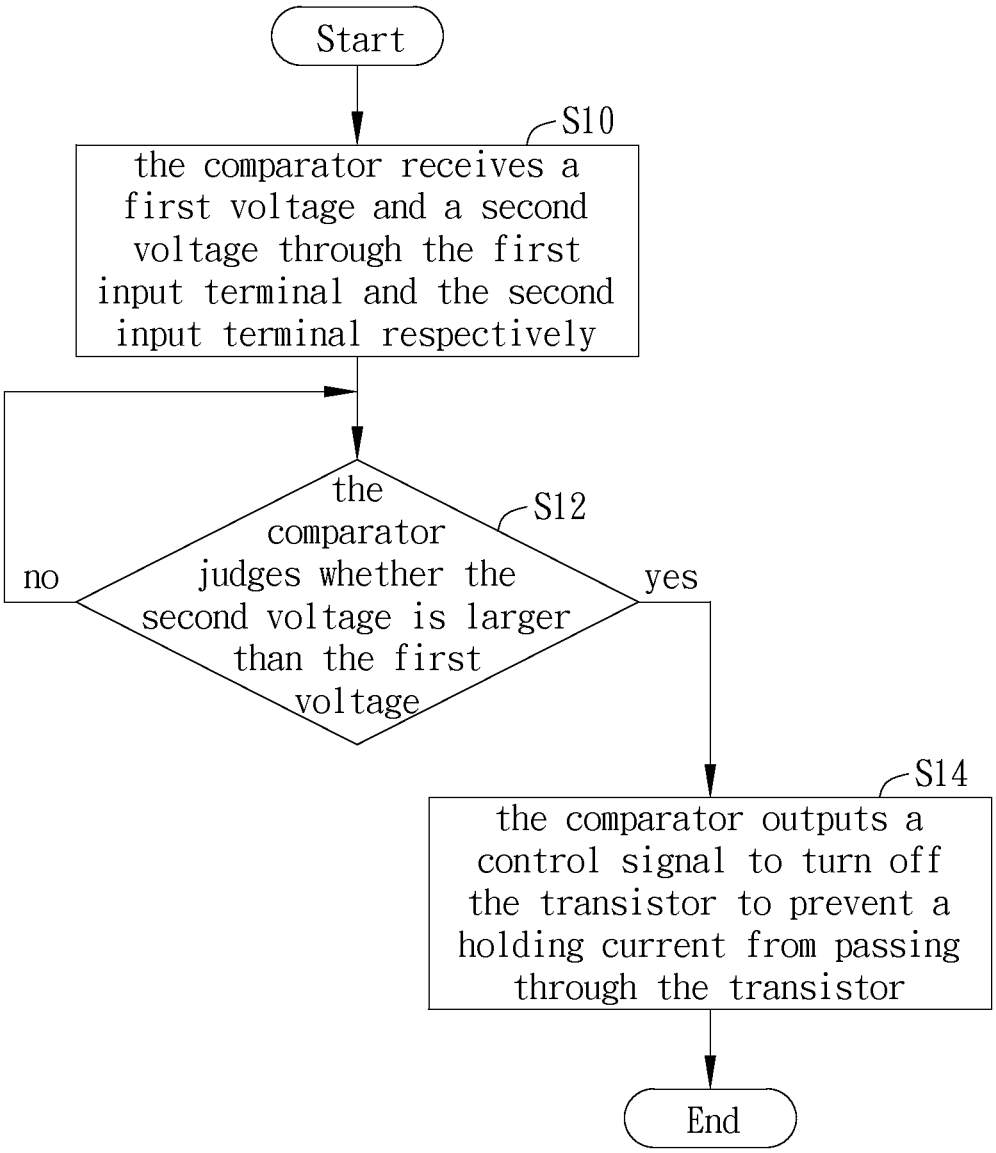
FIG. 9 illustrates a flow chart of the method of operating a holding current circuit of a LED driving apparatus in another embodiment of the invention.

Please refer to FIG. 9. FIG. 9 illustrates a flow chart of the method of operating the holding current circuit of the LED driving apparatus in this embodiment of the invention. As shown in FIG. 9, in step S10, the comparator receives a first voltage and a second voltage through the first input terminal and the second input terminal respectively. Wherein, the first voltage is a fixed voltage of the regulator and the second voltage is a divided voltage between the first resistor and the second resistor. In step S12, the comparator judges whether the second voltage is larger than the first voltage. If the judged result of the step S12 is yes, the method performs step S14 that the comparator outputs a control signal to turn off the transistor to prevent a holding current from passing through the transistor.

Another embodiment of the invention is also a method of operating a holding current circuit of a LED driving apparatus. In this embodiment, the holding current circuit includes an input terminal, a holding resistor, a transistor, a comparator, and a regulator. The holding resistor is coupled between the input terminal and the transistor. The transistor is coupled between the holding resistor and a ground terminal. The regulator is coupled between the ground terminal and the comparator. The comparator is coupled to a gate of the transistor and the regulator.

Figure 10:
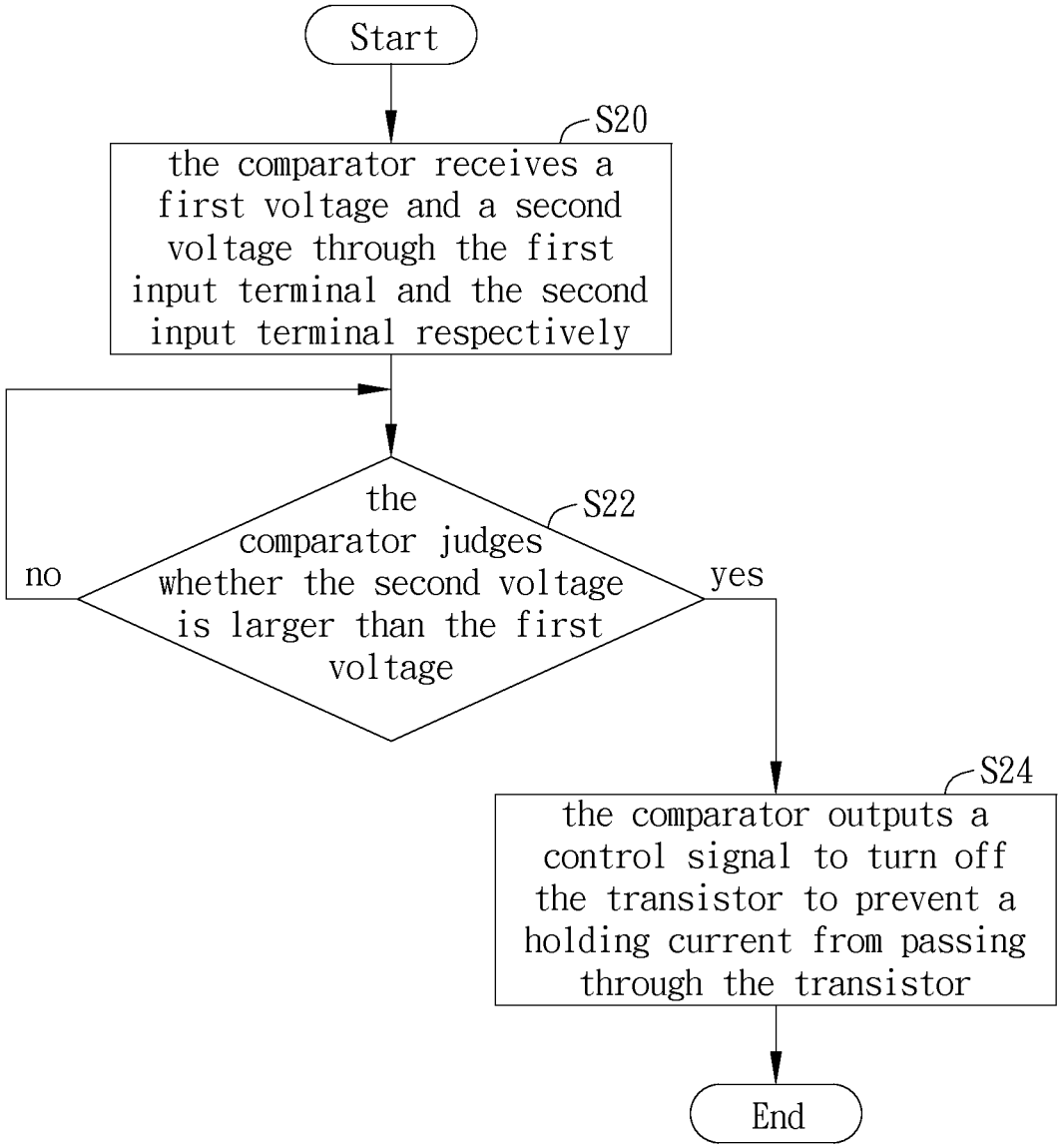
FIG. 10 illustrates a flow chart of the method of operating a holding current circuit of a LED driving apparatus in another embodiment of the invention.

Please refer to FIG. 10. FIG. 10 illustrates a flow chart of the method of operating the holding current circuit of the LED driving apparatus in this embodiment of the invention. As shown in FIG. 10, in step S20, the comparator receives a first voltage and a second voltage through the first input terminal and the second input terminal respectively. Wherein, the first voltage is a fixed voltage of the regulator and the second voltage is a set voltage. In step S22, the comparator judges whether the second voltage is larger than the first voltage. If the judged result of the step S22 is yes, the method will perform step S24 that the comparator outputs a control signal to turn off the transistor to prevent a holding current from passing through the transistor.

Compared to the prior art, the holding current circuit of the LED driving apparatus and operating method thereof disclosed by the invention turn off the holding current circuit at high conduction angle voltage to achieve following effects of: (1) making the input voltage $V_{IN}$ stable at low conduction angle voltage to prevent the flicker of the LED apparatus; (2) effectively overcoming serious problems of high power consumption and over-heat occurred in the prior arts.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A holding current circuit of a LED driving apparatus, comprising:

an input terminal, for receiving an input voltage;

a holding resistor, coupled to the input terminal, a holding current flowing through the holding resistor;

a transistor, coupled between the holding resistor and a ground terminal;

a comparator comprising a first input terminal, a second input terminal, and an output terminal, wherein the output terminal is coupled to a gate of the transistor;

a regulator, coupled between the ground terminal and the first input terminal of the comparator;

a first resistor, coupled to a LED string; and a second resistor, coupled between the first resistor and the ground terminal;

wherein the second input terminal of the comparator is coupled between the first resistor and second resistor, the comparator receives a first voltage and a second voltage through the first input terminal and the second input terminal respectively and judges whether the second voltage is larger than the first voltage, if the judged result of the comparator is yes, the comparator outputs a control signal to turn off the transistor to prevent the holding current from passing through the transistor.

2. The holding current circuit of claim 1, wherein the first voltage is a fixed voltage of the regulator and the second voltage is a divided voltage between the first resistor and the second resistor.

3. The holding current circuit of claim 1, further comprising:

a third resistor, coupled to the ground terminal;

another transistor, coupled between the LED string and the third resistor; and an operational amplifier, two input terminals of the operational amplifier being coupled to a reference voltage and coupled between the another transistor and the third resistor respectively, and an output terminal of the operational amplifier being coupled to a gate of the another transistor.

4. A holding current circuit of a LED driving apparatus, comprising:

an input terminal, for receiving an input voltage;

a holding resistor, coupled to the input terminal, a holding current flowing through the holding resistor;

a transistor, coupled between the holding resistor and a ground terminal;

a comparator comprising a first input terminal, a second input terminal, and an output terminal, wherein the output terminal is coupled to a gate of the transistor; and a regulator, coupled between the ground terminal and the first input terminal of the comparator;

wherein the comparator receives a first voltage and a second voltage through the first input terminal and the second input terminal respectively and judges whether the second voltage is larger than the first voltage, if the judged result of the comparator is yes, the comparator outputs a control signal to turn off the transistor to prevent the holding current from passing through the transistor.

5. The holding current circuit of claim 4, wherein the first voltage is a fixed voltage of the regulator and the second voltage is a set voltage.

6. The holding current circuit of claim 5, further comprising:

a resistor, coupled to the ground terminal;

another transistor, coupled between the LED string and the resistor; and an operational amplifier, two input terminals of the operational amplifier being coupled to a reference voltage and the set voltage respectively, and an output terminal of the operational amplifier being coupled to a gate of the another transistor.

7. A method of operating a holding current circuit of a LED driving apparatus, the holding current circuit comprising an input terminal, a holding resistor, a transistor, a comparator, a regulator, a first resistor, and a second resistor, the holding resistor being coupled between the input terminal and the transistor, the transistor being coupled between the holding resistor and a ground terminal, the first resistor and the second resistor being coupled between a LED string and the ground terminal, the comparator being coupled to a gate of the transistor, the regulator, and coupled between the first resistor and the second resistor, the method comprising steps of:

(a) the comparator receiving a first voltage and a second voltage through the first input terminal and the second input terminal respectively and judging whether the second voltage is larger than the first voltage; and (b) if the judged result of the comparator is yes, the comparator outputting a control signal to turn off the transistor to prevent a holding current from passing through the transistor.

8. The method of claim 7, wherein the first voltage is a fixed voltage of the regulator and the second voltage is a divided voltage between the first resistor and the second resistor.

9. The method of claim 7, wherein the holding current circuit further comprises a third resistor, another transistor, and an operational amplifier, the third resistor is coupled to the ground terminal, the another transistor is coupled between the LED string and the third resistor, two input terminals of the operational amplifier is coupled to a reference voltage and coupled between the another transistor and the third resistor respectively, and an output terminal of the operational amplifier is coupled to a gate of the another transistor.

10. A method of operating a holding current circuit of a LED driving apparatus, the holding current circuit comprising an input terminal, a holding resistor, a transistor, a comparator, and a regulator, the holding resistor being coupled between the input terminal and the transistor, the transistor being coupled between the holding resistor and a ground terminal, the regulator being coupled between the ground terminal and the comparator, the comparator being coupled to a gate of the transistor and the regulator, the method comprising steps of:

(a) the comparator receiving a first voltage and a second voltage through the first input terminal and the second input terminal respectively and judging whether the second voltage is larger than the first voltage; and (b) if the judged result of the comparator is yes, the comparator outputting a control signal to turn off the transistor to prevent a holding current from passing through the transistor.

11. The method of claim 10, wherein the first voltage is a fixed voltage of the regulator and the second voltage is a set voltage.

12. The method of claim 11, wherein the holding current circuit further comprises a resistor, another transistor, and an operational amplifier, the resistor is coupled to the ground terminal, the another transistor is coupled between the LED string and the resistor, two input terminals of the operational amplifier are coupled to a reference voltage and the set voltage respectively, and an output terminal of the operational amplifier is coupled to a gate of the another transistor.

* * * * *